US005571297A

United States Patent [19]

Swei et al.

[11] Patent Number: 5,571,297

[45] Date of Patent: Nov. 5, 1996

[54] DUAL-CURE BINDER SYSTEM

[75] Inventors: Gwo S. Swei, East Amherst; Anthony C. Gaeta, Lockport; Wen L. P. Yang, Ballston Lake, all of N.Y.; Jane L. Cercena, Ashford, Conn.

[73] Assignee: Norton Company, Worcester, Mass.

[21] Appl. No.: 469,286

[22] Filed: Jun. 6, 1995

[51] Int. Cl.[6] ..... B24D 3/02

[52] U.S. Cl. ..... 51/298; 51/295

[58] Field of Search ..... 51/293, 295, 298

[56] References Cited

U.S. PATENT DOCUMENTS 4,652,274 3/1987 Boettcher et al. ..... 51/298

5,520,711 5/1996 Helmin ..... 51/298

*Primary Examiner*—Deborah Jones

*Attorney, Agent, or Firm*—David Bennett

[57] ABSTRACT

A coated abrasives having very desirable efficiencies in production is provided by the use of a binder coat which comprises a compound having at least one function that is radiation curable and at least one function that is polymerizable under thermally activated conditions.

22 Claims, No Drawings

DUAL-CURE BINDER SYSTEM

BACKGROUND OF THE INVENTION

This invention relates to a process for the production of coated abrasives using a novel dual-curing binder system.

In the conventional production of coated abrasives, a backing material is coated with a first resin coat, known as a maker coat, and a layer of abrasive particles are deposited thereon either by gravity coating or by an electrostatic projection, ("UP"), process. The function of the maker coat is to act as a primary anchor firmly bonding the grits to the backing. This maker coat is cured to ensure that the bond is firm before the main coating that holds the grits rigidly during grinding is applied. This is known as the size coat. The size coat is then cured, and occasionally a supersize coat is applied over the top to provide a grinding aid, anti-static additive or other adjuvant close to the point at which the coated abrasive contacts the surface to be ground when in use.

For many years phenolic resins have been the preferred component of the size coat on account of their excellent physical properties. They have also been preferred as the maker coat, partly because of their excellent adhesion to conventional backing materials and phenolic size coats. By using such similar binder coats it is possible to partially cure the maker and complete the cure at the same time as the cure of the size coat. Phenolics are also popular because they are cheap and because they are applied in an aqueous solution such that no organic solvents that need to be recycled or disposed of in an environmentally acceptable manner are involved.

Phenolic resins have drawbacks however, including the need to remove water before cure is initiated. In addition the prolonged heating required to complete a uniform cure without blistering often lasts many hours. The process of curing is usually operated in a continuous mode wherein a coated abrasive sheet many meters in length is fed slowly into long ovens. The ovens in which the cure occurs are called festoon ovens and the product to be cured is draped in long folds over support slats and these folds move at a pre-determined rate through the oven. The supports over which the sheet is folded often cause defects on the back of the sheet and a misorientation of the grain in the other surface where the maker resin is receiving the initial cure.

For this reason there have been many suggestions for replacement of phenolic resins by other binder products. It has been proposed for example, to use acrylate resins, urea-formaldehyde resins, polyurethane resins, polyester resins, melamine resins, epoxy resins, and alkyd resins.

Some of these are curable by radiation treatment such as by the use of UV light or electron beam radiation. These can be quite expensive and have limitations on the amount of conventional filler material because the particles can prevent effective cure of the parts of the resin binder in the "shadows" behind the particles where little or no radiation penetrates. UV cure radiation has a quite shallow depth of cure in most situations in fact. Electron beam radiation has greater depth of cure but if the dosage is large, the backing material may be deteriorated, leading to premature product failure.

The other binders proposed, while often being well-adapted to specialized uses such as lightweight or waterproof abrasives or very fine grit abrasive products, in general do not provide sufficient strength and efficiency to displace the versatile phenolic resins that are used in the greatest number of coated abrasive products.

A binder formulation has now been discovered that is extremely versatile and effective, particularly when used as a maker coat and the present invention provides a process for making coated abrasive using such a binder.

GENERAL DESCRIPTION OF THE INVENTION

According to a first aspect of this invention there is provided for the production of a coated abrasive comprising:

a. Forming an abrasive layer on a backing material, said abrasive layer comprising abrasive grits and a bi-functional binder formulation comprising a compound having at least one radiation-curable function and at least one thermally curable function per molecule;

2. Using radiation to at least partially cure the radiation-curable functions; and 3. Subsequently completing the cure by activation of the thermally curable functions.

The binder component is described being "bi-functional" and by this intended that the binder contain two different types of functional groups that cure by different mechanisms. It is however contemplated the each molecule of binder may have more than one, for example from 1 to 3 or even more of each type of functional group. Preferred binders however have one of both kinds of functional group.

According to a further aspect of this invention, the partial cure of the bi-functional binder is followed by deposition of a phenolic size coat which is then thermally cured at the same time as the cure of the bi-functional binder is completed.

A further aspect of the invention is the use of a maker coat that comprises a bi-functional compound having at least one radiation-curable function and at least one thermally-curable function, wherein the compound is a liquid in the uncured state. Since the maker is itself a liquid, no solvent need be removed before curing can be initiated, thus greatly accelerating the curing process. Such formulations are referred to as having 100% solids, indicating thereby that no weight is lost upon cure.

In a further embodiment of the invention the binder layer comprising the bifunctional component may be applied as a size coat, that is, over the top of a layer of abrasive particles adhered to the backing by means of a conventional maker resin layer, (such as a phenolic resin maker coat), or over a maker coat that also comprises a bi-functional binder component.

The bi-functional compound comprises at least one and often as many as three or more radiation-curable functions, by which is meant groups that react with similar groups when activated by radiation such as UV light or an electron beam. The reaction may be initiated by free-radical or cationic initiation and of course different species of initiators or promoters are applicable in each case. Typical radiation-curable functions include unsaturated groups such as vinyl, acrylates, methacrylates, ethacrylates, cycloaliphatic epoxides and the like. The preferred UV-curable functions are acrylate groups. Where the bi-functional compound comprised a single UV-curable group, it may be desirable to incorporate a minor amount of a further compound containing groups reactive with the UV-curable group such di-acrylates, tri-acrylates and N-vinylpyrrolidone. Suitable reactive diluents include trimethylol propane triacrylate, (TMPTA); triethylene glycol diacrylate (TRPGDA); hexane diol-diacrylate, (HDODA); tetraethylene glycol diacrylate, (TTEGDA); N-vinyl pyrrolidone (NVP) and mixtures thereof. Such additives are very effective in adjusting initial viscosity and determining the flexibility of the cured formulation. They may be added in amounts up to about 50% by weight. This permits control over the formulation viscosity, the degree of cure and the physical properties of the partially cured bi-functional compound. In addition it is preferred that such added reactive compounds be liquid or soluble in the mixture as to add no solvent that needs to be removed prior to cure.

Cure by means of UV radiation is usually sufficient to ensure adequate retention of the abrasive grains during subsequent processing before curing of the thermally curable functions is completed.

The thermally-curable function may be provided for example by epoxy groups, amine groups, urethanes or unsaturated polyesters. The preferred thermally curable function is however the epoxy group since this will result in a plurality of terminal hydroxyl groups on the cured binder which would ensure that a size coat deposited thereon and comprising a resin that will react with the epoxy group such as phenolics, urea/formaldehyde resins and epoxy resins would bond firmly thereto, so decreasing the risk of delamination during use.

Cure of the thermally-curable functions is preferably accelerated or promoted by the addition of known catalysts such as peroxides or 2-methyl-imidazole.

The backbone of the bifunctional binder is not critical beyond providing a stable, essentially non-reactive support for the functional groups that does not interfere with the cure reactions. A suitable backbone is based on a bisphenol derivative such as bisphenol A or bisphenol E. Other possible backbones may be provided by novolacs, urethanes, epoxy-novolacs and polyesters.

These backbone compounds can be reacted by known techniques to form terminal epoxide groups which are of course thermally curable. Such epoxidized backbone materials are well-known. To obtain the bi-functional binder components of the invention this epoxidized derivative is then reacted with a compound containing a function that is reactable with the epoxide function and also contains a radiation-curable function. The amount of the compound added is less than the stoichiometric amount that is required to react with all the epoxide functions present in the molecule. A typical compound may contain an acrylic or methacrylic group and an active-hydrogen containing group, and suitable examples include acrylic and methacrylic acids. The active hydrogen-containing group reacts with the epoxide group, replacing that (thermally-curable) functionality with a (radiation-curable) (meth)acrylate functionality.

The relative amounts of the epoxidized backbone and the radiation curable compound are important in that they control the relative degrees of curing that can occur in the radiation and thermal curing phases of the complete cure of the bi-functional binder compound. Usually the ratio of thermally curable groups to radiation-curable groups in the bifunctional binder is from 1:2 to 2:1 and most preferably about 1:1.

DETAILED DESCRIPTION OF THE INVENTION

The bi-functional binder composition can be applied directly to the backing and then receive a coating of the abrasive grit. Alternatively a mixture of the grit and binder can be made and this mixture is then applied directly to the backing material. This is most frequently done when the abrasive grit is very fine and the application for which the coated abrasive is intended in a fining or finishing application. In such situations a subsequent size coat application may be unnecessary.

The binder composition can additionally contain catalysts or activators designed to initiate or accelerate the radiation or thermal cure operations. It can also include filler materials. It is however, preferred that such fillers do not interfere with the radiation curing whether because of the amount or size of the particles or because the material is essentially UV transparent much as aluminum tri-hydrate. Fillers may often be treated with a coupling agent such as a silane which results in improved adhesion between the filler and the binder so as to increase the dispersion and retention of the filler in the formulation. Addition of fillers is very effective to reduce the cost of the binder system and at the same time increase the physical strength of the cured binder layer. The addition of a filler treated with a coupling agent is therefore a preferred feature of the binder formulations according to the invention.

A preferred bifunctional binder formulation component is an epoxy-acrylate with a bisphenol A backbone reacted at each end to provide epoxy groups, one of which is then acrylated by reaction with acrylic acid. A resin of this description is available from UCB Chemicals under the registered trademark Ebecryl 3605.

The above bifunctional binder, (styled hereafter "3605"), was evaluated in a number of experiments to determine the extent of cure measured by the amount of heat evolved, (Joules/g), by either differential photo calorimetry, (for the UV cure), or differential scanning calorimetry, (for thermal cure). In each case the glass transition temperature, (Tg), is measured. This to indicates the degree of cure attained, with higher Tg values equated to higher degrees of cure.

The same amount of 3605 was used in each case and the amount (if any) of initiator or catalyst is indicated. The additives used were:

Darocure 1173, (a free radical photo initiator of UV Cure available from Ciba-Geigy);

Cyracure UV1-6974, (a cationic photo initiator of UV cure available from Union Carbide Corporation);

2 MI (2-methyimidazole which is a thermal cure initiator); and

TBHP (t-butyl hydroperoxide which is an initiator of thermal cure).

In most cases an additional thermal cure was applied to complete the cure. The Tg at each stage was measured.

| Cure Mode/ Additive | Heat Generated (J/g) | Tg (°C.) | Tg after added Ther. Cure (°C.) |
|---|---|---|---|
| UV/3% 1173 | 152.6 | 23.38 | 27.97 |
| Therm./2% TBHP | 254 | 31.98 | 34.46 |
| UV/4% 6974 | 130.9 | 24.81 | 71.1 |
| Thermal/2% 2MI | 93.95 | 24.78 | — |
| UV/3% 1173 + 2% 6974 | 163.4(UV) | 35.34 | 91.91 |
| UV + Thermal/ 3% 1173 + 2% 2MI | 126.7(UV) 42.84(Thermal) | 45.98 | 55.29 |
| *Thermal + UV/ 2% 2MI + 3% 1173 | 98.44(Thermal) 0.7(UV) | 19.15 | 25.66 |

*If the cure of the thermally polymerizable groups precedes that of the UV curable groups, the latter polymerization is significantly inhibited and retarded. For this reason the reverse order of activation is usually preferred.

It will be noted that the addition of a subsequent thermal cure operation after the bi-functional binder functions have been cured resulted in enhanced properties and this is a preferred feature of the present invention.

To save expense, the binder formulation according to the invention, when applied as a maker coat, can be pattern-coated on the backing such that when abrasive grits are applied to the backing material, they adhere only to the binder in the applied pattern. Because the binder can then be radiation-cured in seconds, the grain is retained in place and a size applied over the top will penetrate between the grains and bond directly to the backing. This is particularly advantageous if the size coat is a phenolic resin and the backing is of a hydrophilic nature such that the phenolic resin bonds readily thereto. It may also be desirable to incorporate reactive fillers into such size coating so as to ensure optimum placement at all stages during the grinding.

DESCRIPTION OF SPECIFIC EMBODIMENTS

The invention is now described with reference to specific formulations. These are not however to be understood as implying any limitation on the essential scope of the invention.

A typical fiber-backed abrasive disc using fused alumina/zirconia grits and phenolic maker and size coats were duplicated with the difference that a binder formulation according to the invention was substituted for the phenolic maker coat.

The binder formulation had the composition;

| | |
|---|---|
| Reactants: | |
| 3605 (bifunctional binder) | 80% by wt. |
| N-vinylpyrollidone | 20% by wt. |
| Additives: | |
| 2MI (Initiator) | 1% of reactants wt. |
| 1173 (Initiator) | 3% of reactant wt. |
| $Al(OH)_3$ (7.5 m) | 50% of reactant wt. |

The grit sizes used were 80 grit.

The binder formulation was applied at about 267 g/m$^2$, (18 lbs/ream). The samples were UP-coated with grit at 178 g/m$^2$, (12 lbs/ream). Two sheets were produced.

The samples were cured using UV light, (set on "high", with a speed of passage under the light source of 3.05 m/min., (10 ft/minute), with each sheet given two passages to ensure complete cure.

The sheet samples with maker coats as described above were then treated with a commercial phenolic size coat at an add-on weight of 207 g/m$^2$, (14 lbs/ream).

Both sheets were then cured as follows:

1 hour at 65.6° C. (150° F.);

1 hour at 79.4° C. (175° F.); and 16 hours at 107.2° C. (225° F.).

7" discs were cut from these sheets and tested by angle grinding on the edge of a 3.18 mm, (one eighth inch), thick bar of C-1018 steel.

The disc was supported on a pad and urged against the steel bar at 3.64 kg or 2.73 kg; (8 lbs or 6 lbs respectively) at an angle of 15° or 10° respectively and moved relative to the bar. The time of contact in each case was 30 seconds. The weight loss of the disc and the bar were measured after each contact and after each contact the condition of the edge was examined. The results were as follows:

| Sample # | Contact | Disc 1st Change | Bar at change | Ratio | Comments on Edge |
|---|---|---|---|---|---|
| 1 | 1 | 0.99g. | 11.34g. | 11.45 | Acceptable |
| (15° angle, | 2 | 0.30g. | 12.15g. | 40.50 | Acceptable |
| 8 lb weight), | 3 | 0.15 | 10.52 | 70.13 | Acceptable (new Bar) |
| Hand pad backing | 4 | 0.16 | 10.88 | 68.00 | Acceptable |
| 2 | 1 | 0.83 | 12.20 | 14.70 | Not very good |
| (10° angle, | | | | | |
| 6 lb. wt. | 2 | 0.20 | 9.97 | 49.85 | Acceptable |
| Soft pad | 3 | 0.07 | 10.17 | 145.29 | Acceptable |
| backing) | 4 | 0.04 | 9.65 | 241.25 | Acceptable (New Bar) |

The performance of the discs was comparable to that of commercial all-phenolic binder discs. It was noticeable that the phenolic size coat adhered extremely well to the maker coat according to the invention.

What is claimed is:

1. A process for the production of a coated abrasive said process comprising a. Forming an abrasive layer on a backing material, said abrasive layer comprising abrasive grits and a bi-functional binder formulation which comprises a compound having at least one radiation-curable functionality and at least one thermally curable functionality per molecule;

b. At least partially curing the radiation-curable functionality; and c. Subsequently completing the cure by activation of the thermally curable functionality.

2. A process according to claim 1 in which the radiation-curable functionality is UV-curable.

3. A process according to claim 1 in which the radiation-curable functionality is selected from the group consisting of acrylate, methacrylate or cycloaliphatic epoxy groups.

4. A process according to claim 1 in which the thermally-curable functionality is an epoxy group.

5. A process according to claim 1 in which the abrasive is formed by applying the bi-functional binder formulation as a maker coat and depositing the abrasive grits thereon.

6. A process according to claim 5 in which the bi-functional binder composition is pattern-coated on the backing material.

7. A process according to claim 1 in which the bifunctional binder composition is a component of a size coat.

8. A process according to claim 1 further comprising applying a size coat comprising a resin having groups reactable with the bi-functional binder over the abrasive layer.

9. A process according to claim 8 in which the size coat comprises a phenolic resin.

10. A process according to claim 8 in which the size coat is cured at the same time as the thermally curable functionality of the bi-functional binder formulation.

11. A process according to claim 1 in which the bi-functional binder formulation is 100% solids.

12. A process according to claim 1 in which the bi-functional binder formulation comprises additional monomers or oligomers containing one or more groups copolymerizable with the radiation-polymerizable functionalities of the bi-functional compound.

13. A process according to claim 1 in which the bi-functional binder formulation also comprises a filler.

14. A process according to claim 13 in which the filler has been surface treated with a coupling agent to increase its compatibility with the binder.

15. A process according to claim 1 in which, after the cure of the bi-functional binder component is essentially complete, the coated abrasive product is subjected to a further thermal cure operation.

16. A process for the production of a coated abrasive which comprises:

a. Coating a backing layer with a maker formulation comprising a compound having at least one UV-curable (meth)acrylate group and at least one thermally-curable epoxy group;

b. Applying a layer of abrasive grits to the maker formulation;

c. Exposing the maker coat to UV radiation sufficient to at least partially cure the UV-curable (meth)acrylate group; and d. Subsequently curing the epoxy group.

17. A process according to claim 16 in which the maker formulation comprises other groups copolymerizable with the (meth)acrylate groups.

18. A process according to claim 16 in which the maker formulation is 100% solids.

19. A process according to claim 16 further comprising applying a phenolic size coat over the abrasive layer and curing at the same time as the thermally curable functionality of the maker formulation.

20. A process according to claim 16 in which the maker formulation is pattern-coated on the backing material.

21. A process according to claim 16 in which the coated abrasive is subjected to a thermal cure operation after the cure of the maker formulation is essentially complete.

22. A process according to claim 16 in which the maker formulation also comprises a filler that has been surface modified by reaction with a silane.

* * * * *